United States Patent [19]

Trabbic

[11] Patent Number: 4,507,923

[45] Date of Patent: Apr. 2, 1985

[54] HYDRAULIC DEVICE

[76] Inventor: Thomas D. Trabbic, Fuerstenberger Strasse 231, 6 Frankfurt/Main, Fed. Rep. of Germany

[21] Appl. No.: 504,849

[22] Filed: Jun. 17, 1983

Related U.S. Application Data

[63] Continuation of Ser. No. 215,703, Mar. 19, 1981, abandoned.

[51] Int. Cl.[3] ..... F15B 7/00

[52] U.S. Cl. ..... 60/583; 60/585; 60/591; 60/594

[58] Field of Search ..... 60/583, 591, 589, 594, 60/585, 592

[56] References Cited

U.S. PATENT DOCUMENTS

| | | | |
|---|---|---|---|
| 1,988,066 | 1/1935 | Zavarella | 60/583 |
| 2,227,593 | 1/1941 | Lawrence | 60/589 |
| 2,464,367 | 3/1949 | Balogh | 60/594 |
| 3,030,776 | 4/1962 | Kustusch | 60/594 |
| 4,116,004 | 9/1978 | Geary | 60/583 |
| 4,149,384 | 4/1979 | Marshall | 60/583 |
| 4,248,045 | 2/1981 | Turner | 60/583 |

FOREIGN PATENT DOCUMENTS

| | | | |
|---|---|---|---|
| 1171575 | 2/1957 | France | 60/589 |

*Primary Examiner*—Abraham Hershkovitz
*Attorney, Agent, or Firm*—David D. Murray

[57] ABSTRACT

A hand held manually operable hydraulic auxiliary device for lifting or pressing of loads or for operating of tools includes a hydraulic cylinder having pressure and activating pistons disposed between which is a valve housing including inlet and discharge channels and being furnished with non-return valves.

The hydraulic cylinder including both the actuating piston operable by a manually operated lever, and the pressure piston, as well as the valve housing are disposed within an outer casing receiving the hydraulic fluid. The outer casing at least on the pressure piston side thereof is provided with a tool adapter. The valve members include a forced reset guide. Disposed in the area of the pressure side of the hydraulic cylinder is a randomly operable detent.

14 Claims, 5 Drawing Figures

HYDRAULIC DEVICE

This application is a continuation of application Ser. No. 215,703 filed Mar. 19, 1981, now abandoned.

BACKGROUND OF THE INVENTION

The present invention is concerned with a hydraulic hand held manually operable auxiliary device for lifting or pressing of loads but also for operating of tools.

Hydraulic devices of this type are, as far as the hydraulic elements are concerned, generally known in the art, for, any piston operated pressure hydraulic, as a rule, comprises a hydraulic cylinder and a valve housing provided with inlet and discharge channels and having correspondingly operating valves. However, the constructions of such housings may be different.

Manually operable, hydraulic auxiliary devices for lifting of loads, with the manual operation being, of course, effected via an actuating lever adapted to the respective task, are known, for example in the form of lifting motor car jacks, especially for use in workshops which, however, in their all-over construction are designed for the specific lifting functions. The same applies to lifting and lowering hydraulic systems, for example, for fork-lift trucks, into which they are firmly assembled. Apart from the fact that all these prior art devices are determined for specific working operations with a corresponding device adaptation, thus being not universally applicable, they cannot, as a rule be used in any desired postion, which is, however, desirable for a universally utilizable device that is to be manually held and operated.

SUMMARY OF THE INVENTION

It is an object of the invention to provide a hydraulic device of the character indicated, i.e. a hydraulic auxiliary device that is manually operable but also manually holdable and directly utilizable as a "tool", respectively, which device is suitable both for lifting of loads and for operating of tools and which can be placed into operation in any desired postion.

Another object is to provide a hydraulic device the outer casing of which is so small-dimensioned that it can be held by hand and that the required operating elements are within the area of access of the hand.

A specific object is to provide a hydraulic device the adapter of which is so constructed that the whole unit can be adapted to different cases of use.

A general object is to meet the above objects with inherent simplicity of construction and ease of handling and use.

The foregoing objects and other features are achieved by the invention as applied to a hydraulic device having means as follows:

The hydraulic cylinder including both the actuating piston operable by a hand lever and the pressure piston, as well as the valve housing are disposed within an outer casing receiving the hydraulic fluid. The outer casing at least at the pressure piston side thereof is provided with a tool adapter. The valve members include a reset forced guide. In the area of the pressure side of the hydraulic cylinder, a randomly operable detent is disposed.

What is thus essential of the auxiliary device is the arrangement of the two pistons in one cylinder advantageously permitting the whole system to be constructed in the form of a handle that can be gripped with effortless ease; moreover, it is essential for the valve bodies to be provided with a reset forced guide thereby safeguarding that the hydraulic device remains effectively operable in any position and, finally, it is esential to provide at least one tool adapter that renders the device useful both for the lifting of loads and for the operating of tools.

DESCRIPTION OF THE PREFERRED EMBODIMENT

Figure 1:
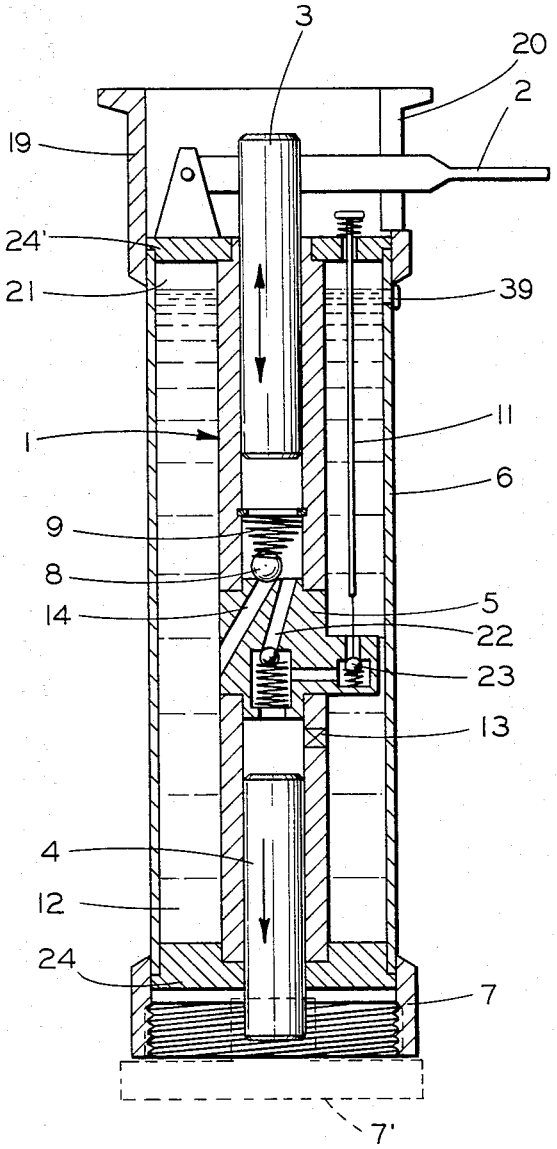
FIG. 1 shows, in section, one form of embodiment of the auxiliary device.
Figure 2:
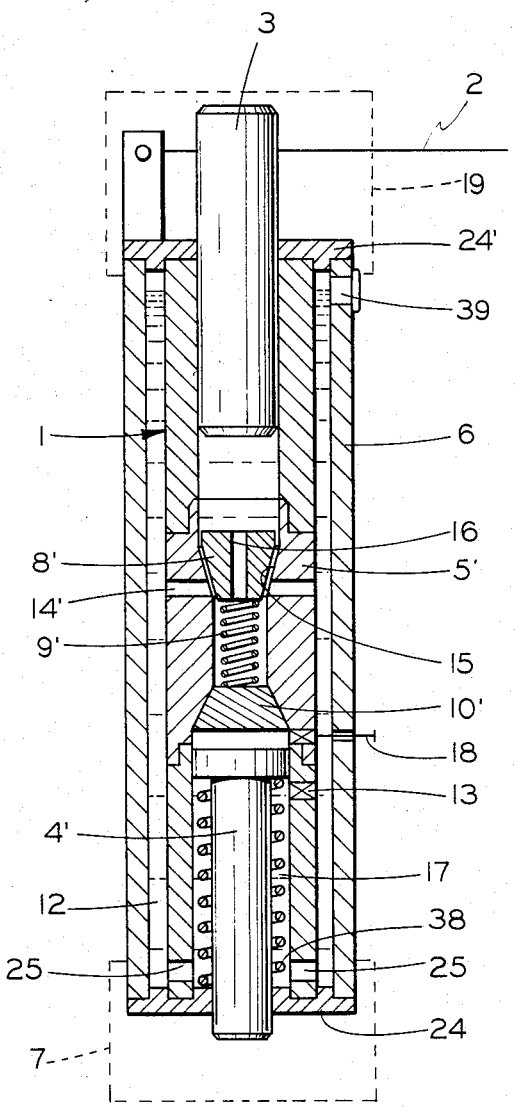
FIG. 2 shows, in section, a preferred form of embodiment.

According to FIGS. 1 and 2 the auxiliary device essentially consists of the outer casing 6 closed at the top and bottom, disposed in which casing is the hydraulic cylinder 1 including the actuating piston 3 and the pressure pistons 4 and 4', respectively. The actuating piston 3 could, of course, also be disposed transverse of the pressure piston 4, 4', especially so as it must only be operated with short strokes. Apart from a correspoding structural change the principle of operation would not be changed.

The hydraulic cylinder 1 is formed of two parts that enclose the valve housing 5 approximately midway.

It is especially where the device is to be used as a lifting or compressing element that a supporting element 19 is disposed at the upper end of the device, which supporting element should, of course, be provided with a lateral slot 20 if, as shown, the hand lever 2 for pumping the actuating piston 3 is disposed at the top rather than laterally at the external casing 6. In that case the adapter would consist at the other end of a supporting plate 7' adapted to be screwed, for example, on the piston end.

Supporting element 19''' (FIG. 5) equally can be disposed detachably or replaceably and can be provided with a bayonet fixing, respectively. Such an adapter or such a construction as shown in FIG. 1 will, of course, not be required if piston 3 were seated transversely in the cylinder and if hand lever 2 were disposed laterally as in that case the closure lid 24' could itself form the abutment face.

The so formed auxiliary device may, for example, be used for laterally lifting a passenger car or for pressing apart heavy loads, with the deivce, due to its construction individually to be described in the following, remaining operable in any desired position.

Due to the adapter construction of the pressure piston side the device can also be used as an auxiliary tool, with the whole device serving as a "handle" so to speak for the tool. Such a tool can, for example, be a tong-type element 30 (FIG. 3) by way of which screws, nuts, tubes or the like of different sizes can be gripped as, for example, by way of a pipe wrench, with the adapter being equipped with a transformation means 26 of a corresponding configuration that transforms the lift movement of the emergent pressure piston 4 into a movement suitable for the actual tool as demonstrated. The advantage involved therewith resided in that the tool jaws at a high locking force can be mounted to the element to be loosened or tightened.

The interior space 12 of the outer casing 6, with the exception of a minor free space 21, is filled with a suitable hydraulic fluid. If the hand lever 2 and thus the actuating piston 3 is moved up and down (for resetting the hand lever 2, feasibly, a reset spring is provided) hydraulic fluid is drawn in by piston 3 through the suction channel 14 and during the downward movement of the piston 3 through the overflow channel 22 is urged downwardly against the pressure piston 4 which thereby emerges from the bottom part of the hydraulic cylinder 1 and from the auxiliary device, respectively.

What is essential in this respect is that the valve body 8 (of a spherical configuration in FIG. 1) is force-guided by a spring 9 in order to fulfil its locking function over the suction channel 14 in any position of the auxiliary device.

Releasing of the pressure piston 4 from the pressure position is effected by means of the detent 11. If the same is depressed return-flow valve 23 opens so that the hydraulic fluid can flow back into space 12 of the outer casing when pressure piston 4 is set back. Additionally provided in the bottom part of the hydraulic cylinder 1 is a correspondingly adjusted safety valve 13 responsive to a predetermined pressure such that no further pressure increase can be exerted any longer on piston 4 as otherwise the whole of the lower closure lid 24 could be pressed off.

The embodiment according to FIG. 2 is the preferred one in which the pressure piston is formed as a stepped piston 4', with a free space 17 thus being formed under the piston stepping. The said free space 17 at the bottom end is in communication with the interior space 12 by at least one channel 25. It is thereby possible to keep the total fluid volume of the device very low, and all internal spaces of the device can be completely filled, with the hydraulic fluid being pumped back and forth. Valve casing 5' is of a different construction inasmuch as it is provided with two opposite, truncated valve seats 15, and valve bodies 8', 10' are correspondingly formed truncatedly. The two valve bodies 8', 10' by way of a tension spring 9' are biased with respect to one another and are held in closing position against the valve seats. The at least one suction channel 14' terminates into the upper seat area 15. Preferably, at least three suction channels 14' are disposed in housing 5' in a uniform peripheral distribution.

When lifting the actuating piston 3 valve body 8' rises slightly against the action of the tension spring 9' thereby releasing the mouth of the suction channel 14' so that hydraulic fluid can flow in. Upon depression, the valve body 8' will close so that the hydraulic fluid will have to pass through the passage channel 16 in the valve body 8' thereby pressing open the valve body 10' so that fluid is applied to the pressure piston 4'. The relief of the pressure piston 4' is effected via a correspondingly disposed detent 18. a safety valve 13 is equally provided. The function of the said safety valve 13 will, of course, not be required if a stop for the pressure piston is provided by the tool concerned as such.

Figure 3:
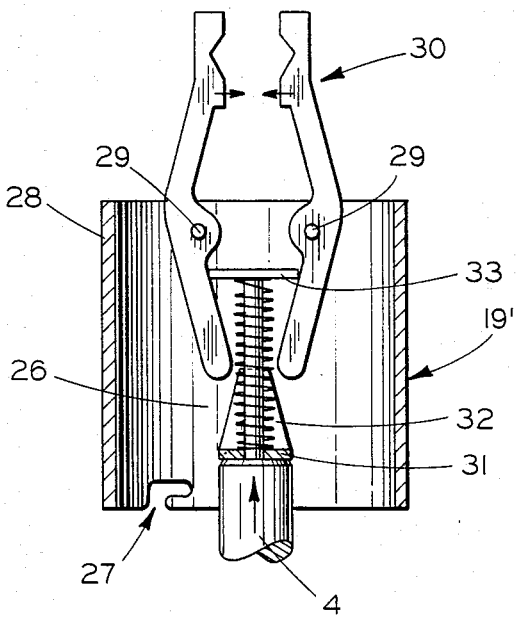
FIGS. 3 to 5 show various forms of adapters.

As set forth above, adapter 19' according to FIG. 3 can be formed of a sleeve 28 fixed to housing 6, for example, by means of a bayonet joint 27, in which sleeve two spring-biased tong elements 30 are seated on bearing 29. The motion mechanics 26 consists of a key 32 disposed on a movable bridge 31, with bridge 31 being equally spring-biased and disposed on stationary supports 33 of the sleeve. From the piston 4 emerging from housing 6 bridge 31 and thus key 32 is pressed upwardly between the tong elements 30 closing thereby.

Figure 4:
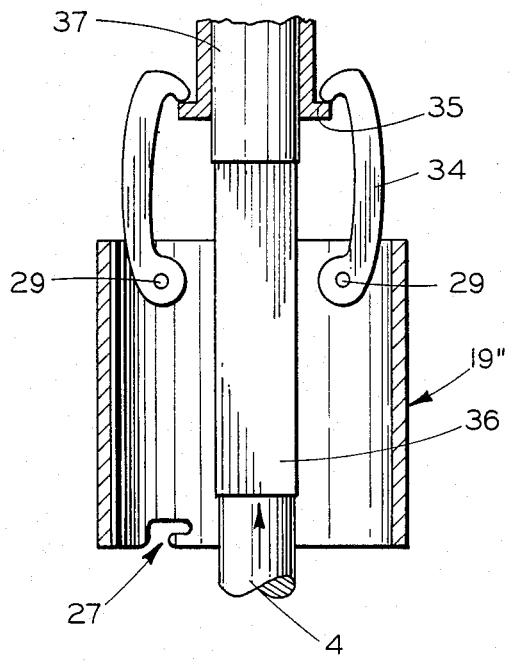

In FIG. 4, adapter 19" has still simpler construction as a withdrawal means. At least two hook-shaped elements 34 are mounted to the element 35 to be withdrawn while piston 4 possibly under the insertion of an intermediate element 36, exerts a pressure on the counter-element 37.

Figure 5:
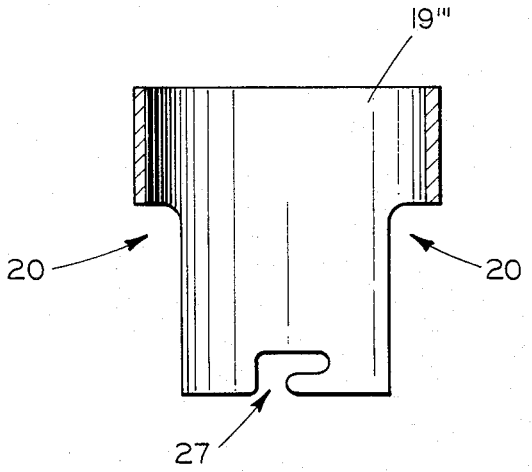

Adapter 19" according to FIG. 5 is equally formed as a sleeve adapted to be mounted onto the housing 6, with the sleeve being provided with one or two slots 20 for a hand lever 2 to reach through. Such a sleeve is determined as an attachment in case the upper end and the closure lid 24', respectively cannot itself be used as an abutment area.

Without an adapter or sleeve, for example, also sheet metal parts as known in chassis plumbing, can be disposed directly at the end of piston 4 so that the device is equally useful in this field of application.

All required openings of the device are, of course, correspondingly sealed. Filling with the hydraulic fluid, ventilation and evacuation, respectively, are effected through a correspondingly sealed opening 39.

Although the size of the auxiliary device as demonstrated in FIGS. 1,2 is not binding, it should be noted that the device can be constructed even smaller or larger than demonstrated. Conversely there will be no objections to giving the housing an extended length for obtaining an increased lever arm, to to provide an extension adapter.

As disclosed by FIG. 2 the stepped piston 4' in free space 17 is provided with reset spring 38 which, however, may also be disposed outside the housing 6 bringing about the same effect, and is then connected to piston 4. A reset spring 38 to be disposed externally is especially applicable in the embodiment according to FIG. 1.

In place of tension spring 9' valve bodies 8', 10' respectively at the piston side can be biased by a compression spring each (not shown), for ease of assembly.

What is claimed is:

1. A hand held hydraulic drive unit comprising, in combination, an outer elongate casing, a fixed inner elongate casing disposed within said outer casing, said inner casing defining first and second chambers, a pair of opposed end means extending between said inner and said outer casings for defining a fluid reservoir, a first piston slidably disposed within said first chamber, pivot means disposed on one of said pair of opposed end means, lever means coupled to said pivot means and said first piston for manually reciprocating said first piston, first check valve means for providing unidirectional fluid flow from said fluid reservoir to said first chamber, a second piston slidably disposed within said second chamber, said second piston extendible beyond the other of said pair of opposed end means, second check valve means for providing unidirectional fluid flow from said first chamber to said second chamber, and return valve means activated by said lever means for selectively establishing communication between said second chamber and said reservoir.

2. The hydraulic drive unit of claim 1 wherein said outer casing and said inner casing are generally circular.

3. The hydraulic drive unit of claim 1 wherein said outer casing and said inner casing are circular and disposed in generally coaxial relationship.

4. The hydraulic drive unit of claim 1 wherein said first chamber and said second chamber are coaxially aligned.

5. The hydraulic drive unit of claim 1 wherein said pivot means, lever means and said first piston are arranged to form a second class lever.

6. The hydraulic drive unit of claim 1 further including means adjacent said other opposed end for receiving and securing accessory devices.

7. The hydraulic drive unit of claim 1 further including a collar disposed on said outer elongate casing generally adjacent said one of said pair of opposed end means, said collar extending beyond the axial limit of travel of said first piston.

8. The hydraulic drive unit of claim 1 wherein said return valve means includes an activating member operably aligned with said lever means for transferring motion from said lever means to said return valve means.

9. The hydraulic drive unit according to claim 1, characterized in that said first check valve means and said second check valve means are formed as opposite truncated cones under bias and further including a valve housing having an inlet channel communicating with said first check valve means and an outlet channel communicating with said second check valve means.

10. The hydraulic drive unit according to claim 1, characterized in that said second piston is formed as a stepped piston, said stepped piston having a face and free space opposite said face, said free space communicating with said fluid reservoir through at least one passage.

11. The hydraulic drive unit according to claim 1, characterized in that a reset spring is connected to said second piston.

12. The hydraulic drive unit according to claim 1, characterized in that said first check valve means and said second check valve means are biased by a tension spring disposed therebetween.

13. The hydraulic drive unit according to claim 1, characterized in that each of said check valve means is biased by a respective spring.

14. The hydraulic drive unit according to claim 1, characterized in that at least three suction channels are disposed in said inner casing adjacent said first check valve means.

* * * * *